US006688485B1

(12) United States Patent
Lauer et al.

(10) Patent No.: US 6,688,485 B1
(45) Date of Patent: Feb. 10, 2004

(54) BASE-MOUNTED, TILTED BOWL

(75) Inventors: Jennifer L. Lauer, P.O. Box 756, Wilmette, IL (US) 60091; Marianne H. Michel, Des Moines, IA (US); Kevin Krauss, Belmont, MA (US); John Lapetina, Newton, MA (US)

(73) Assignee: Jennifer L. Lauer, Wilmette, IL (US)

( * ) Notice: Subject to any disclaimer, the term of this patent is extended or adjusted under 35 U.S.C. 154(b) by 129 days.

(21) Appl. No.: 09/613,911

(22) Filed: Jul. 11, 2000

(51) Int. Cl.[7] ..... A47G 19/00; B65D 25/24

(52) U.S. Cl. ..... 220/574; 220/630; 220/631; 220/636

(58) Field of Search ..... 220/630, 574, 220/574.1, 631, 636

(56) References Cited

U.S. PATENT DOCUMENTS

| | | | | | |
|---|---|---|---|---|---|
| 766,427 | A | | 8/1904 | Crowell | |
| 1,659,383 | A | | 2/1928 | Thiene et al. | |
| 2,121,165 | A | | 6/1938 | Clobodkin | 65/15 |
| 2,213,837 | A | | 9/1940 | Gill | 65/15 |
| 2,329,279 | A | | 9/1943 | Lower | 65/15 |
| 2,588,990 | A | | 3/1952 | Sanchez | 65/15 |
| 2,659,920 | A | * | 11/1953 | Bogan et al. | 132/73.5 |
| 2,748,952 | A | * | 6/1956 | Fleit et al. | 211/74 |
| D180,329 | S | | 5/1957 | Highberger | 44/15 |
| 3,100,054 | A | | 8/1963 | Rubens | 215/1 |
| 3,632,015 | A | * | 1/1972 | Barth | 215/393 |
| 4,351,444 | A | | 9/1982 | Majewski | 220/20 |
| 5,295,598 | A | * | 3/1994 | Gerlach et al. | 215/376 |
| 5,423,452 | A | | 6/1995 | Tardif | 220/574 |
| 5,474,206 | A | * | 12/1995 | Herring, Sr. | 220/630 |
| 5,626,256 | A | | 5/1997 | Onneweer | 220/574 |
| 5,662,241 | A | * | 9/1997 | Sorensen | 220/630 |

* cited by examiner

*Primary Examiner*—Joseph M. Moy
(74) *Attorney, Agent, or Firm*—Polit & Erickson, LLC

(57) ABSTRACT

A bowl assembly includes a base having a concave receiving area and a bowl with a compatibly shaped bottom for being fit within said receiving area. The bowl and the base include engaging formations for a mutual releasable engagement. In an alternate embodiment the bowl and base are formed as a single piece. In a further alternate embodiment, the bowl can be adjusted to assume a range of tilt angles with respect to the base. The bowl can be tilted toward the user to assist young children in retrieving food from the bowl with a utensil.

20 Claims, 5 Drawing Sheets

BASE-MOUNTED, TILTED BOWL

BACKGROUND OF THE INVENTION

The present invention relates to bowls for serving food. Particularly, the invention relates to bowls for feeding young children.

Young children that are of an age to be trained to feed themselves, typically consume food from a bowl using a spoon. One of the more difficult tasks for such young children in this regard, is the manipulation of the spoon into the bowl and the retraction of the spoon out of the bowl to retrieve an amount of food on the spoon for consumption. Due to the relative complexity of this task, children still developing eye-hand coordination have difficulty depleting all of the food from the bowl, which then requires the assistance of a parent to remove and serve all of the food from the bowl.

The present invention recognizes that one of the reasons for this difficulty for young children, is that, with the conventional upright orientation of the bowl, the spoon must be positioned over the bowl and then tilted and dipped downwardly to retrieve portions of food, and then tilted and lifted upwardly and retracted so as to retain food on the spoon and so as not to interfere with the inside surface of the rear side wall portion of the bowl (side wall portion closest to the child). Also, the present invention recognizes that the more confining convex shape of a bowl bottom can be difficult to sweep with a spoon to scoop food, compared to the generally cylindrical side wall of the bowl.

The present invention recognizes that it would be desirable to provide a bowl for feeding young children which was adapted for easy access by a utensil that is held and manipulated by a small child.

SUMMARY OF THE INVENTION

The present invention provides a two part bowl assembly for serving food that includes a base and a bowl, the base configured to hold the bowl such as to be tilted toward a food child. The open mouth of the bowl at least partially faces the child. By tilting the bowl toward the child, the child has an increased utensil access into the bowl for retrieving food for consumption. The requirement of manipulating a utensil, such as raising, tilting and lowering the utensil to enter the bowl mouth, is substantially alleviated. Therefore, small children, without the eye-hand-coordination of an adult, can sufficiently manipulate a food utensil into the open mouth of the bowl to retrieve food.

Importantly, when the bowl is in the angular orientation, low levels of food can be scooped with a spoon from the bowl cylindrical sidewall which is less confining to spoon movement than is the convex bowl bottom. Additionally, the angular orientation of the open mouth of the bowl allows the child to see more completely into the bowl to observe the food to be retrieved by the utensil. This increased access and visibility also assist the small child in loading or "scooping" the utensil with food. Additionally, due to the fact that the bowl edge is relatively elevated on a front side thereof (furthest from the child), and depressed on a rear side thereof, a front wall portion of the bowl can serve as a guide or backing surface in directing a utensil into the bowl.

According to the a first exemplary embodiment of the invention, the base has a relatively wide foot print for being supported on a flat surface, such as a table surface, and which includes a central concave area. The concave area is sized and shaped to be compatible with the convex bottom surface of the bowl such that when the bowl is fit into the concave area it can be tilted toward the food consumer.

The base and the bowl further include interengaging frictional fit parts that hold the bowl to the base in a tilted orientation. In this regard, the bowl includes a mounting ring, and the base includes an aperture that tightly receives the mounting ring. The aperture is irregularly shaped, as described below, to assist in a gripping of the mounting ring. The mounting ring can also include a lug or key that inserts into a slot formed into the base to ensure proper angular orientation of the bowl with respect to the base, about a central axis of the bowl.

According to a second exemplary embodiment of the invention, the bowl is formed as a one-piece molded body having a base region defining a supporting plane and a bowl region having a central axis and defining a bowl mouth or edge. The bowl mouth and the central axis are tilted with respect to the supporting plane. As a further aspect, the base region can be hollow and define a second bowl and the supporting plane can define a second bowl mouth. The second bowl and the bowl region are alternately usable food-holding bowls. If the user desires to use the second bowl, the molded body is just turned over giving access to the second bowl. Advantageously, the alternately usable food holding bowls can be of different sizes, or depths or concavities, providing a flexibility of usage, depending on the nature of the food being served, for example, a small deep bowl region can be used for ice cream, and a wide flat second bowl can be used for spaghetti.

According to a third exemplary embodiment, a two-piece bowl assembly is provided which includes a base and a bowl. The base and the bowl have interengaging elements which allow the bowl to be adjustably tilted with respect to the base. This feature provides the advantage that the bowl can be adjustably tilted depending on the level of food in the bowl, or tilted base on the viscosity of the food held therein, or tilted based on the age and eye-hand coordination of the user, or for any other reason. The relative movability of the bowl to the base can be for amusement purposes as well.

According to a fourth embodiment, the bowl and the base can be configured to resemble or simulate an article, animal, character, etc. and the relative movement of the bowl to the base can incorporated into the desired simulation. For example, the base can be configured to simulate or display an object that would naturally be expected to tilt or pivot with respect to an underlying object, such as, for example, a dump truck bed as the bowl, and a truck cab and chassis as the base.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
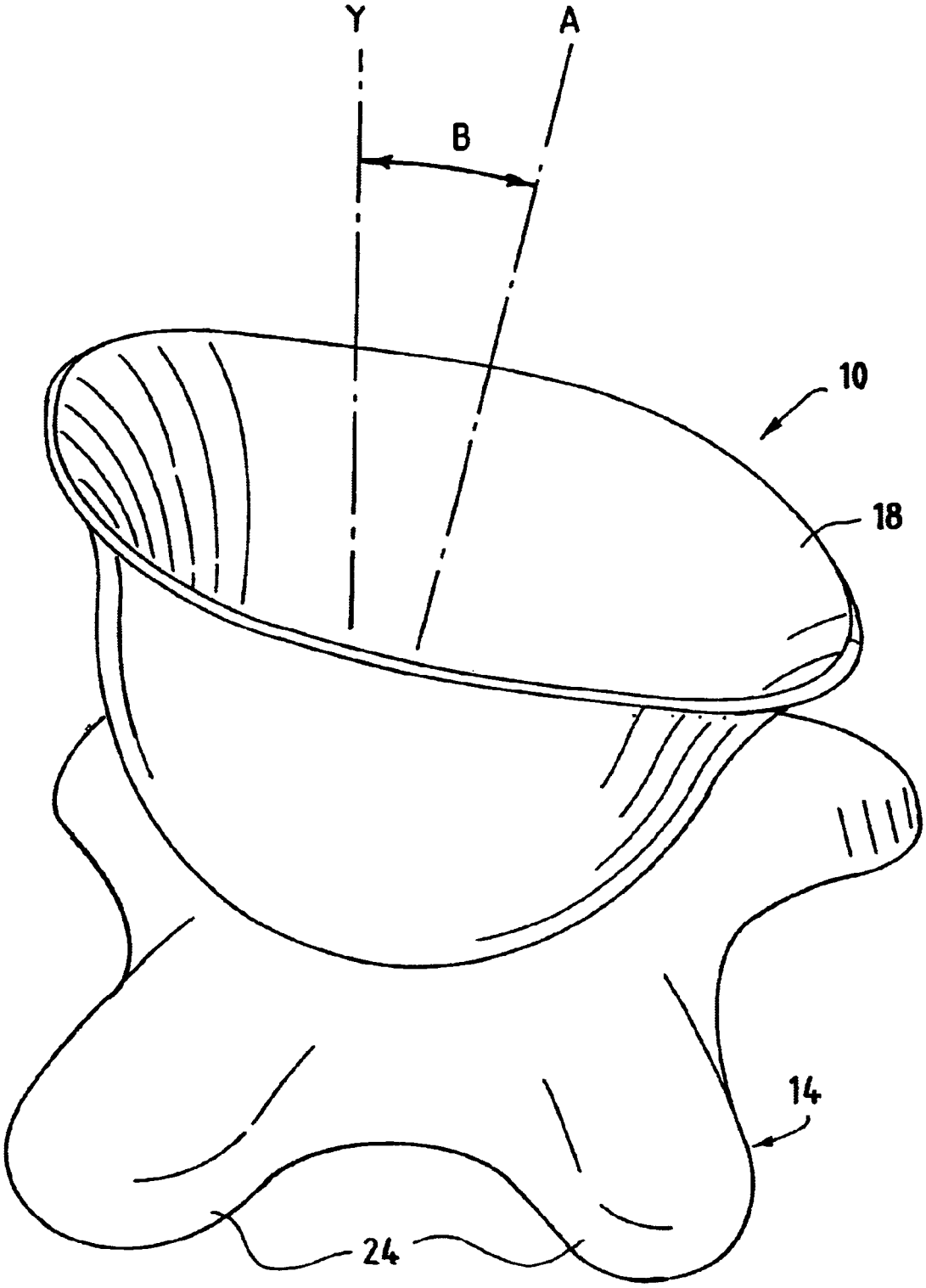
FIG. 1 is a perspective left side view of a bowl assembly according to the present invention.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

FIG. 1 illustrates a first embodiment bowl assembly 10 of the present invention. The bowl assembly 10 comprises a base 14 which supports a bowl 18. The base 14 includes extending leg elements 24 defining a support plane 26 on the under side thereof (shown in FIG. 6 and described below). The plane 26 provide a stable support surface for the bowl assembly 10 to be rested on a tabletop.

The bowl assembly 10 provides a food serving apparatus that is more easily used by young children. The bowl 18 has a central axis A that is tilted to the vertical axis Y at an angle B toward the feeding child. Preferably, this angle B is about 45 degrees. The child can see the food within the bowl, nearly completely to the bottom of the bowl. The child has a greater utensil access into the bowl with a reduced necessity to manipulate the utensil to enter and exit the bowl open mouth. The inclined, substantially cylindrical rear wall portion of the bowl provides less of an obstacle of retraction of the utensil from the bowl toward the feeding child, as the utensil loaded with food can be more easily guided and slipped rearwardly toward the child. The inclined, cylindrical rear wall portion of the bowl is less confining for sweeping a utensil to scoop food, than is the convex bottom of the bowl. Additionally, by tilting the bowl downwardly, a front side of the bowl (furthest from the child) is relatively elevated and can serve as a guiding and scooping backing surface for directing the movement of the utensil within the bowl.

Figure 2:
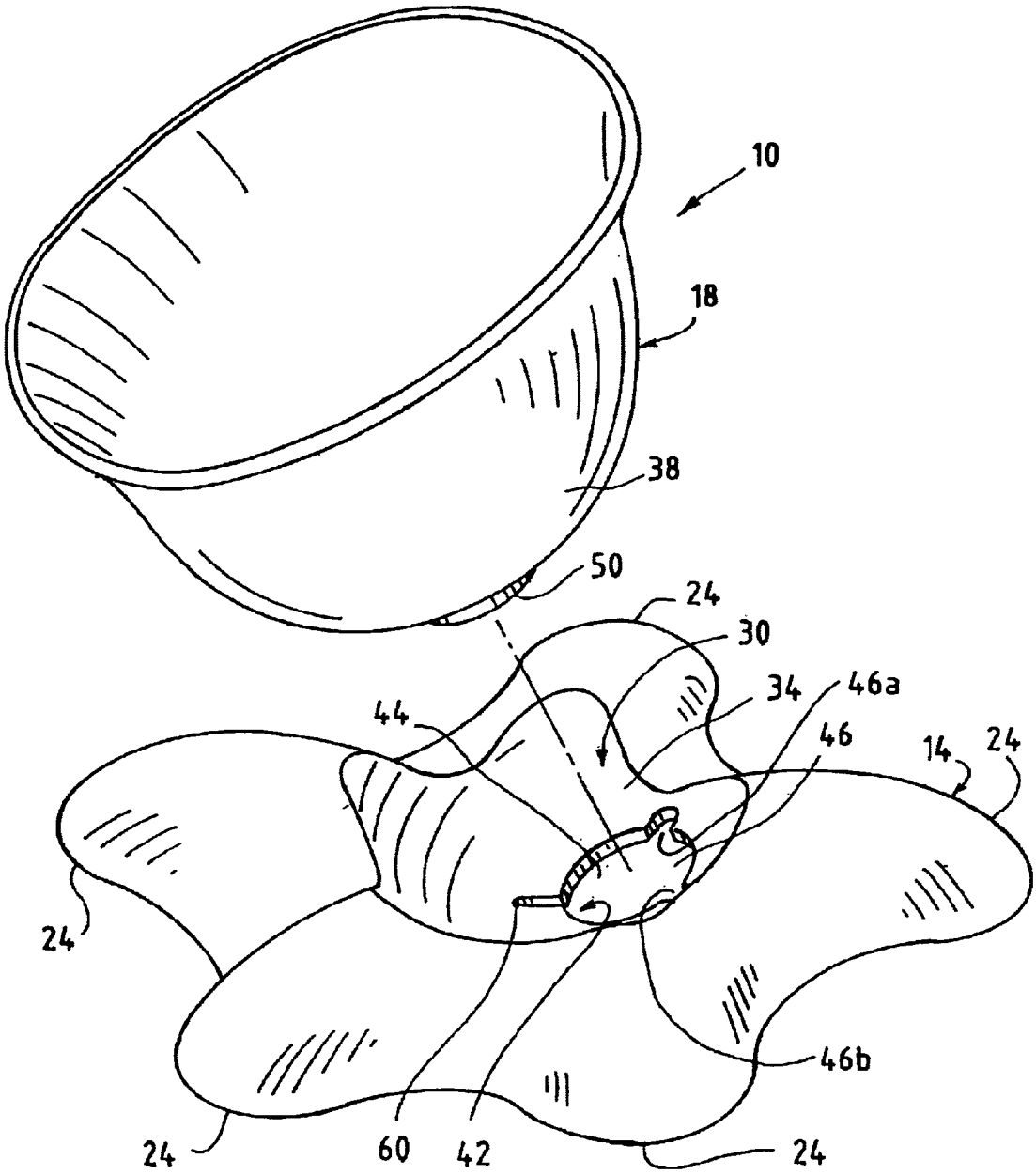
FIG. 2 is an exploded perspective right side view of the bowl assembly of FIG. 1.

FIG. 2 illustrates the assembly 10 in more detail. A concave area 30 is formed on a top side of the base 14. The concave area defines a bowl support surface 34. The bowl 18 includes an outside bottom surface 38 which is sized and shaped to fit stably on the bowl support surface 34, within the concave area 30.

The base 14 includes an aperture 42 located within the concave area 30. The aperture 42 includes a substantially circularly-shaped region 44, and a substantially flatter (larger diameter) circularly-shaped region 46 that are connected by two circularly-shaped notches 46*a*, 46*b*. The bowl includes a mounting ring 50 on a bottom side thereof which is sized to resiliently interfit within said aperture 42. The flattened region 46, with the two circular notches 46*a*, 46*b*, allows for a resilient stretching of the aperture 42, without splitting or cracking, for the base 14 to grip the mounting ring 50 to cause a tight, frictional fit therebetween.

Figure 3:
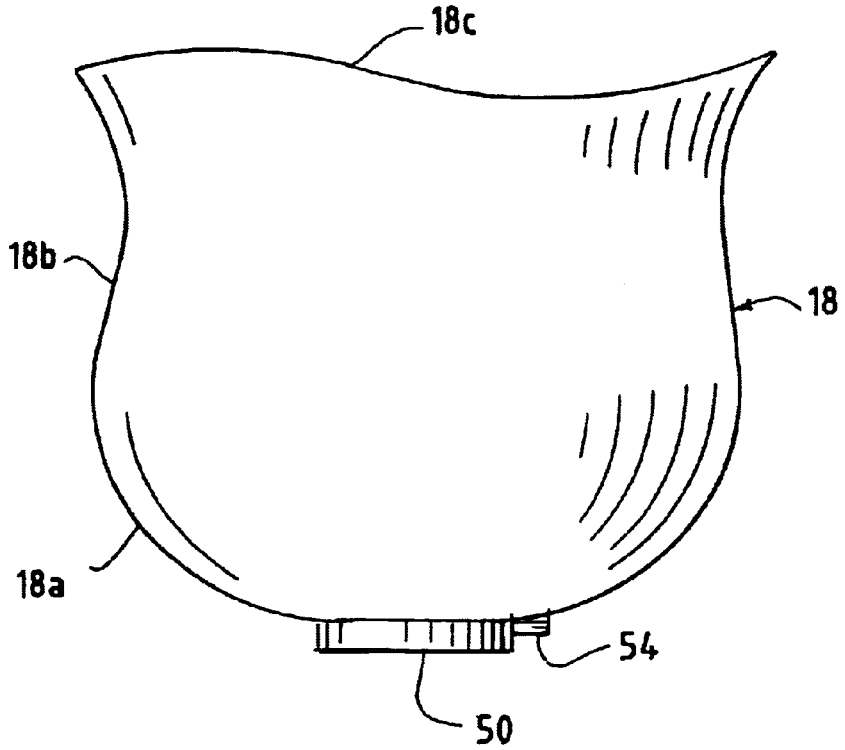
FIG. 3 is an elevational view of a bowl shown in FIG. 1.
Figure 4:
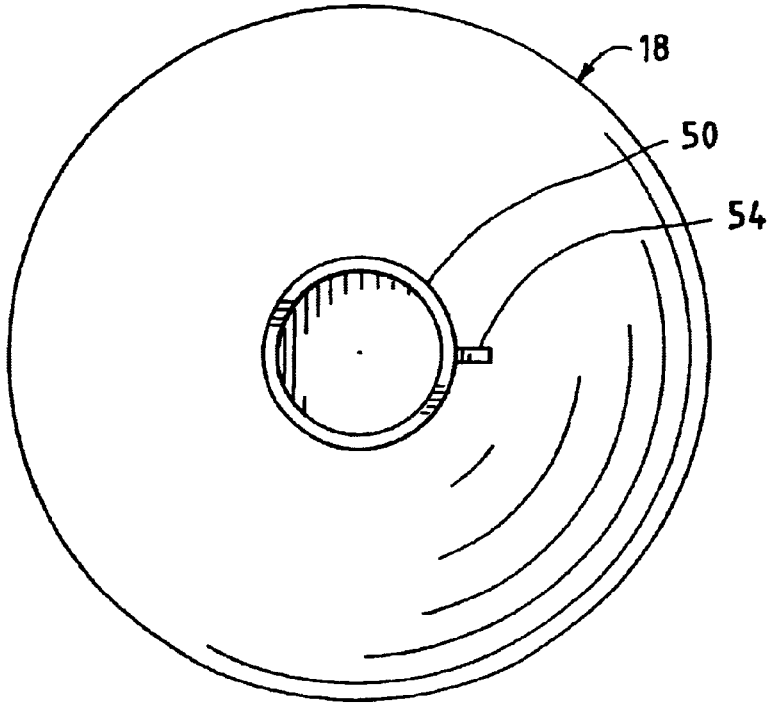
FIG. 4 is a bottom view of the bowl shown in FIG. 3.

The bowl 18 further includes a lug or key 54 extending axially from a bottom surface of the bowl, and elongated in a radial direction from the ring 50 (shown in FIGS. 3 and 4). The base 14 includes a slot 60 at a corresponding position to the lug 54 to receive the lug therein when the bowl 18 is fit down onto the base 14. The interaction of the lug 54 and the slot 60 orients the bowl to the base at a preselected angular orientation about a central axis 18*a* of the bowl. This prevents the bowl from being misaligned about its central axis. In the illustrated embodiment, the lug 54 and the slot 60 extend directly toward a rear side of the assembly, perpendicularly to a tilting axis T (FIG. 5), toward the feeding child.

The correct rotational alignment of the bowl to the base may be important. The correct, preselected alignment of the bowl to the base is particularly advantageous if the bowl includes orientation-dependent logos, decorations, advertising, etc. It may also be advantageous if the shape of the bowl is not rotationally symmetrical and a certain rotational orientation of the bowl to the base is desired for operational reasons. For example, if the bowl has an upper rim of varying height, it may be advantageous to ensure that the tallest portion of the rim is oriented on a front side of the base, away from the consumer. Also, the bowl assembly 10 may be configured such as to resemble or simulate a character, a plant, an animal, an object, or a device when assembled together, such that specific angular orientation of the bowl vis-a-vis the base is required to create the resemblance or simulation.

FIGS. 3 and 4 illustrate the bowl 18. The bowl has a substantially hemispherical lower region 18*a* and a cylindrical upper region 18*b*. The upper region 18*b* flares outwardly to a top edge 18*c* that has an uneven, wavy profile. The overall shape of the illustrated bowl resembles a flower cup or tulip for aesthetic appeal. The mounting ring 50 is illustrated as being circular. The lug 54 is substantially tabular and extends radially from the mounting ring 50.

Figure 5:
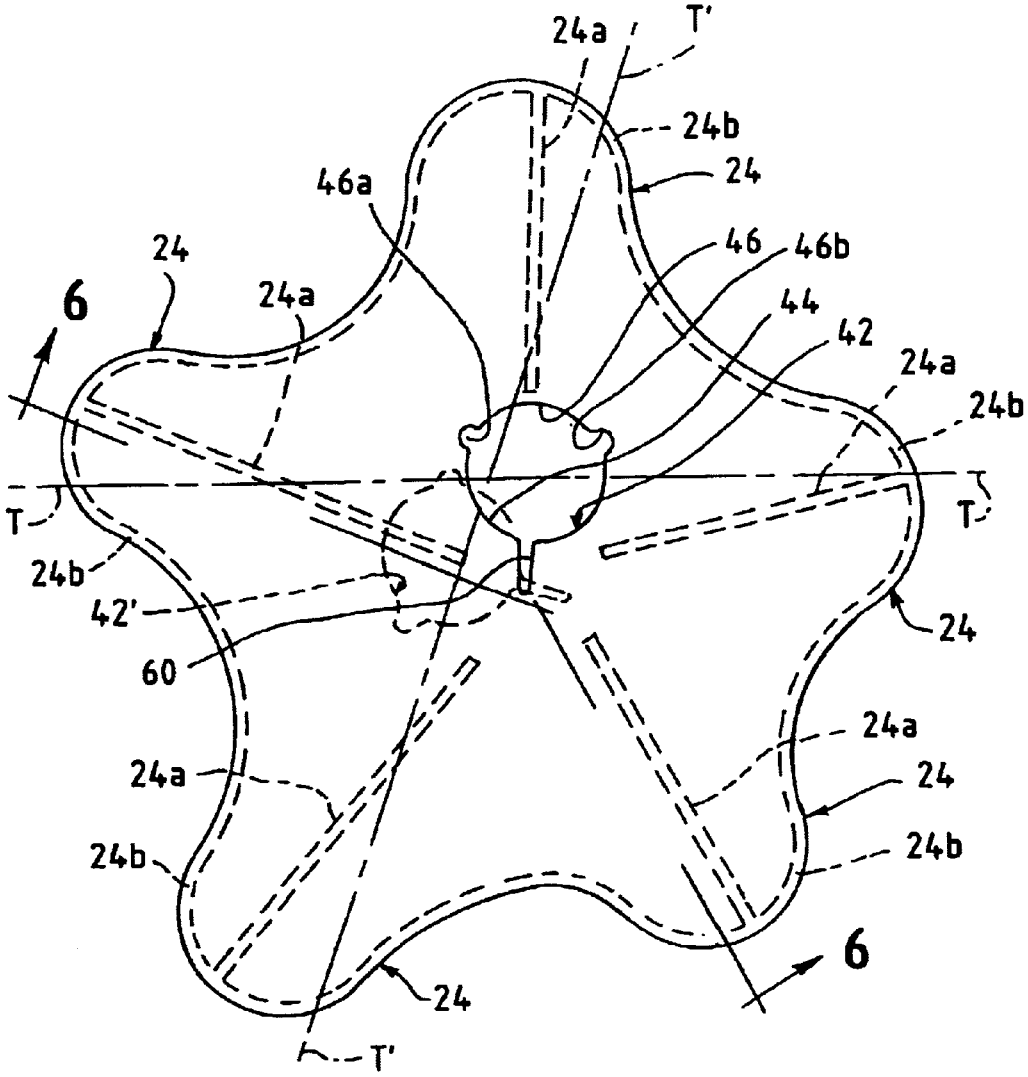
FIG. 5 is a plan view of a base shown in FIG. 1.
Figure 6:
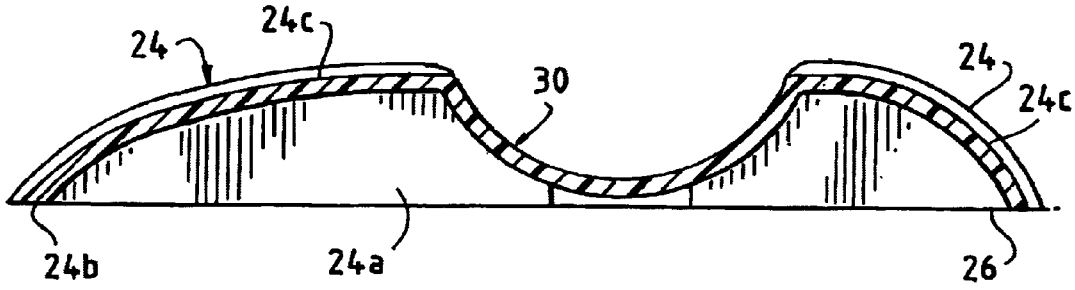
FIG. 6 is a sectional view taken generally along line 6—6 of FIG. 5.

FIGS. 5 and 6 illustrate the base 14 in more detail. The base can have an overall irregular shape due to artistic considerations. However, many different regular and irregular shapes could be used for the base without departing from the principles of the invention. The illustrated base includes five leg elements 24 which form an irregular star shape. The leg elements 24 are formed of convex or arched wall 24*c*, each having a centrally disposed, substantially vertical support wall or rib 24*a* and a partially surrounding edge 24*b*. The base 14 can be supported by a tabletop on the plane 26 that is defined by the vertical support walls 24*a* and the partially surrounding edge 24*b*.

It should also be noted that it may be advantageous to orient the widest span of the base along an alternate axis of tilt T'. This is also demonstrated by the alternate position of the aperture 42, shown in phantom in FIG. 5. The slot 60 extends toward the rear of the assembly (toward the feeding child).

The base and bowl can advantageously both be composed of plastic. Alternately, the base can be composed of elastomeric material, such as rubber, to provide a more resilient gripping of the mounting ring 50 by the aperture 42, and potentially a greater friction between the base 14 and the tabletop to prevent sliding of the bowl assembly.

In addition to the operational advantages of the tilted bowl of the invention, the bowl assembly 10 is also advantageous in that it can be separated into two parts, bowl 18 and base 14, for washing. The bowl 18 can especially be easily washed in a conventional dishwasher due to its compact size. The base 14, since it need not be in contact with the food product, can be washed less vigorously without jeopardizing the sanitary conditions of the bowl 18.

Furthermore, the invention provides the advantage that it is a two part assembly wherein each part can be individually molded. The parts can be of different materials, different textures, or different colors for additional decorative interest. The parts can be shaped to resemble or simulated decorative or functional articles. The illustrated bowl assembly, for example, once assembled, resembles a plant including a flower (the bowl 18) surrounded by leaves (the base 14).

Figure 7:
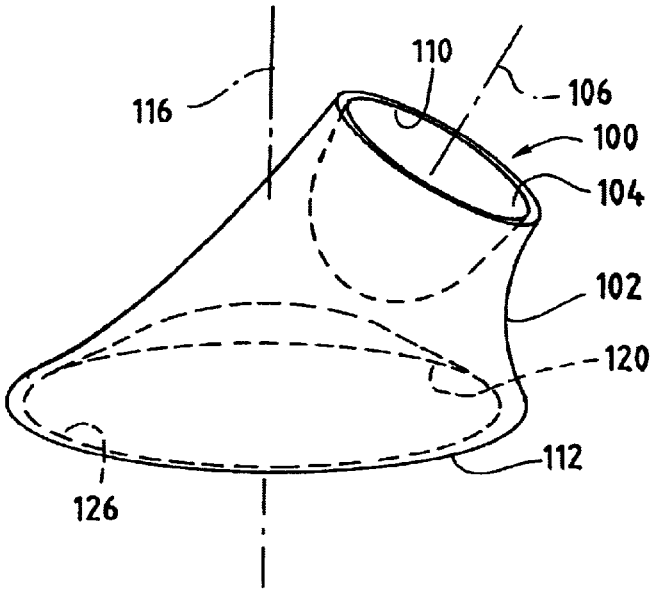
FIG. 7 is a perspective view of a second embodiment of the present invention.

FIG. 7 illustrates a second exemplary embodiment bowl 100 of the present invention. The bowl 100 includes a molded body 102. The molded body 102 includes a first bowl region 104 having a central axis 106 and a bowl edge or bowl mouth 110. The body includes a bottom supporting edge 112 which defines a plane having a perpendicular line 116 thereto. Advantageously, the body 102 includes a second bowl region 120 shown being concave facing downwardly. The second bowl region 120 defines a second bowl mouth or edge 126 which is coplanar with the support edge 112.

According to this embodiment, the axis 106 is tilted with respect to the perpendicular line 116 to provide the tilted bowl advantage of the present invention, as previously described with regard to the first embodiment. Additionally, the embodiment of FIG. 7 provides the advantage that the body 102 is reversible to provide an alternate bowl, the second bowl region 120 for serving food. As can be appreciated from the figure, if the bowl edge 110 is placed downwardly onto a supporting surface the bowl edge 126 would also be at a tilted angle such as toward the user.

Advantageously, the first bowl region 104 has a different size than the second bowl region 120. As illustrated, the first bowl region 104 is smaller and deeper whereas the second bowl region 120 is wider and relatively shallower. Thus, for example, the first bowl region 104 can be used for serving a first type of food such as ice cream, and the second bowl region 120 can be used for serving another type of food such as spaghetti.

Figure 8:
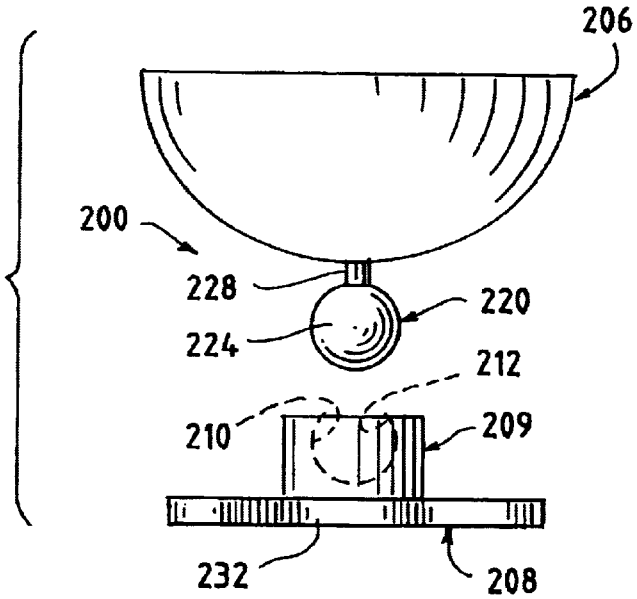
FIG. 8 is an exploded elevational view of a third embodiment of the present invention.

FIG. 8 illustrates a third embodiment bowl assembly 200 of the present invention. The bowl assembly 200 includes a bowl 206 and a base 208. The base 208 includes a ball socket formation 209 at a top thereof which provides a substantially spherical ball socket 210 open at a top opening 212. The bowl 206 includes a ball joint 220 comprising a ball 224 and an extending shaft 228.

When the bowl is assembled to the base, the ball 224 is resiliently forced through the somewhat smaller opening 212 to reside within the cavity 210. The engagement is a snap fit engagement. Once the bowl is snap fit to the base, the bowl can be pivoted on the ball 224 to assume a plurality of angles of tilt about horizontal and vertical axes. The ball 224 is held frictionally within the cavity 210 such that the angle of tilt of the bowl to the base can be changed and will retain its position. Alternatively, rather than a ball and socket joint for holding the base, a pivot type joint having only a single degree of rotary freedom can be used.

The embodiment of FIG. 8 provides the advantage that the angle of tilt of the bowl 206 with respect to the base 208 can be adjusted according to the nature of the food, for example, the viscosity of the food, or for the level of food in the bowl, or to the height of the user sitting in the feeding chair, or to the ability of the user to manipulate a utensil to retrieve food from the bowl. Additionally, the bowl and base assembly illustrated in FIG. 8, given that it includes moving parts, can increase the interest and attention of the feeding person, especially small children.

Figure 9:
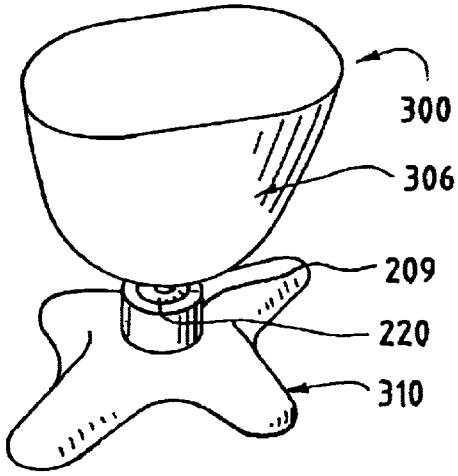
FIG. 9 is a perspective view of a fifth embodiment of the present invention.

FIG. 9 illustrates a fourth exemplary embodiment bowl assembly 300 of the invention. According to the embodiment of FIG. 9 a decorative bowl 306 such as the bowl shown in FIGS. 1 through 4 also includes the ball joint 220 as shown in FIG. 8. A base 310 is provided which can be a decorative base, such as the base shown in FIGS. 1, 2, 5 and 6, except having the ball socket formation 209 as described in FIG. 8. Thus, the two part bowl assembly as described in the first embodiment can incorporate a pivotable feature such as described in FIG. 8.

Additionally, as described for the embodiment of FIGS. 1 through 6, the decorative bowl and base can be configured to simulate or resemble another object, character, or other item. The pivotability of the bowl with respect to the base can also be incorporated into the simulation as appropriate. For example, the bowl could resemble a dump truck bed and the base can be configured to resemble the dump truck cab and chassis, such that the tilting of the bowl with respect to the base would resemble the unloading or dumping of a dump truck. This is only a single example. There are many other examples wherein the tilting or pivoting feature of the bowl provides the additional advantage of increasing the interest and amusement of young children.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A bowl assembly, comprising:

a base having a supporting surface for resting on a flat surface, and a receiving area;

a bowl having a bottom surface for resting at least partially within said receiving area, said bowl comprising a bottom and a sidewall portion at least partially defining a concave inside surface, said sidewall portion having a surrounding edge defining a top opening, and said bowl and said base having complimentary interengaging portions for holding said bowl at an angle of tilt, with said surrounding edge being elevated at a front side of said bowl and depressed at a rear side;

and at said rear side of said surrounding edge, said sidewall portion being smoothly contoured in a direction from said bottom of said inside surface to said top opening, allowing food within said bowl to be swept by a spoon along said inside surface and out through said top opening without interference.

2. The bowl assembly according to claim 1, wherein said receiving area is concave and said bottom surface is convex having a same curvature as said receiving area.

3. The bowl according to claim 2, wherein said receiving area comprises a substantially hemispherical contour.

4. The bowl assembly according to claim 3, wherein said convex shape of said bowl comprises a substantially hemispherical shape.

5. The bowl assembly according to claim 1, wherein said surrounding edge of said bowl is flared outwardly.

6. The bowl assembly according to claim 1, wherein said interengaging portions are configured to be engaged when said bowl is pressed onto said base.

7. The bowl assembly according to claim 1, wherein said interengaging portions comprise a protrusion on one of said bowl or said base and an aperture on a respective other of said bowl or said base for tightly gripping said protrusion.

8. The bowl assembly according to claim 7, wherein said protrusion comprises a ring.

9. The bowl assembly according to claim 1, wherein said bowl and base further comprise second interengaging portions which engage only at a preselected angular orientation of said bowl, with respect to said base, about an axis of said bowl.

10. The bowl assembly according to claim 1, wherein said base is rotationally non-symmetrical.

11. The bowl assembly according to claim 1, wherein said base comprises a plurality of extending leg elements which form said supporting surface.

12. The bowl assembly according to claim 1, wherein said interengaging portions are configured to allow said bowl to be adjustably tilted.

13. The bowl assembly according to claim 12, wherein said interengaging portions comprise a ball and socket joint.

14. A bowl assembly, comprising:

a base having a central area and extending leg elements, said leg elements having supporting surfaces for being supported on a flat surface;

a bowl comprising a bottom and a sidewall portion having a surrounding edge defining a top opening, and a bottom surface, said bowl having an axis passing through said top opening and said bottom, said bottom surface shaped to be held by said central area with said axis at an angle of tilt from vertical, said surrounding edge being elevated at a front side of said bowl and depressed at a rear side;

wherein an area of said top opening taken through a plane perpendicular to said axis is substantially equal to or greater than open areas within said sidewall portion taken along said axis from said open top to said bottom, allowing food within said bowl to be swept by a spoon along said sidewall portion and out through said top opening without interference.

15. The bowl assembly according to claim 14, wherein said bowl and said central area comprises engagement elements which are releasably engaged by pressing said bowl to said base.

16. The bowl assembly according to claim 14, wherein said engagement elements comprise a ring on said bottom surface and an aperture through said central area which tightly receives said ring.

17. The bowl assembly according to claim 14, wherein said surrounding edge is uneven.

18. The bowl assembly according to claim 14, wherein said bottom surface is convex, having a same curvature as said central area.

19. The bowl assembly according to claim 14, wherein said leg elements comprise substantially arched walls having vertical support ribs.

20. The bowl assembly according to claim 14, wherein said base is configured to resemble leaves and said bowl is configured to resemble a flower cup.

* * * * *